US006115872A

United States Patent [19]

Welsh

[11] Patent Number: 6,115,872

[45] Date of Patent: Sep. 12, 2000

[54] SNAP-ON GOLF TOWEL

[76] Inventor: Ronald W. Welsh, 8925 S. 69th East Ave., Tulsa, Okla. 74133

[21] Appl. No.: 09/159,800

[22] Filed: Sep. 23, 1998

[51] Int. Cl.[7] ..... A63B 55/00; A47L 25/00

[52] U.S. Cl. ..... 15/209.1; 206/315.3

[58] Field of Search ..... 15/209.1, 210.1; 150/160; 206/315.3, 315.5

[56] References Cited

U.S. PATENT DOCUMENTS

| | | | |
|---|---|---|---|
| D. 219,197 | 11/1970 | Robinson . | |
| D. 330,140 | 10/1992 | Lerner . | |
| D. 347,542 | 6/1994 | Sheppard, Jr. . | |
| D. 377,131 | 1/1997 | Davis . | |
| D. 385,742 | 11/1997 | Bird . | |
| 2,754,532 | 7/1956 | Kanehl et al. . | |
| 2,968,825 | 1/1961 | Wetherby | 15/210.1 |
| 4,263,950 | 4/1981 | Brown . | |
| 4,403,366 | 9/1983 | Lucke | 15/209.1 |
| 4,771,502 | 9/1988 | Trimble | 15/209.1 |
| 4,912,800 | 4/1990 | Zeltner | 15/210.1 |
| 4,984,684 | 1/1991 | Conner et al. . | |
| 5,075,918 | 12/1991 | Zeltner et al. | 15/210.1 |
| 5,318,292 | 6/1994 | DeMarco . | |
| 5,372,414 | 12/1994 | Lamonakis et al. | 15/209.1 |
| 5,407,723 | 4/1995 | Curtin . | |
| 5,450,954 | 9/1995 | Dunn . | |
| 5,586,674 | 12/1996 | Nachbauer . | |
| 5,761,761 | 6/1998 | An | 15/209.1 |
| 5,770,284 | 6/1998 | Logemann | 15/210.1 |
| 5,771,523 | 6/1998 | Rudolph | 15/209.1 |
| 5,898,968 | 5/1999 | Beattie | 15/210.1 |
| 5,918,341 | 6/1999 | Hale | 15/209.1 |

*Primary Examiner*—Randall E. Chin

*Attorney, Agent, or Firm*—Fellers, Snider, Blankenship, Bailey & Tippens, P.C.

[57] ABSTRACT

A snap-on golf towel including a towel body, female snap and logo patch. The female snap is secured to the golf towel so as to provide means for securing onto a male snap generally located on the outer surface (top cuff) of most traditional golf bags. The snap arrangement thereby provides a convenient method of attaching and detaching the golf towel to/from the golf bag as desired. The female snap further includes a first grommet interlocked with a second grommet through a hole which is punched in the towel body. The logo patch is secured to the towel body so as to cover the first grommet, which, when interlocked with the second grommet forms the back side of the female snap. The second grommet includes the female snap portion. The logo patch provides a media on which advertising or other indicia may be placed to allow the golfer to personalize his/her golf equipment.

9 Claims, 3 Drawing Sheets

SNAP-ON GOLF TOWEL

BACKGROUND OF THE INVENTION

1. Field of the Invention

This invention relates, generally, to golf accessories, and more particularly to golf towels.

2. Background of the Invention

Since the sport of golf is played outdoors, generally in grass, wet conditions caused by rain or dew are common. It is also inherent in the game that the golfer (some more than others), including his or her ball, clubs, shoes and other accessories will find himself or herself in adverse conditions such as water hazards, sand traps, dirt, mud, and/or plants (trees) in addition to the grass. Such materials becoming lodged on the accessory, other than being a nuisance, may affect the performance of the golfer or golf accessory. As a result, a need exists for the golfer to clean such material from himself/herself, or the golf accessory, during play.

As a result, it is common for a golfer to carry a towel on the course useful to clean such materials during play. A problem, however, exists as to how to conveniently carry such a towel. It has been found undesirable for the golfer to simply carry the towel because it may affect the performance of the golfer. It has also been found undesirable to carry the golf towel in one of the storage compartments of the golf bag since the towel may be used before or after each shot depending on the conditions. The delay/nuisance of storing and removing the towel from the golf bag is unacceptable.

An additional problem frequently encountered is that cleaning a golf accessory such as the head of a golf club often requires two hands. A need exists for a golf club towel which is supported so as to allow the golfer convenient access leaving both hands free to clean and/or dry his or her hands or an accessory.

One known type of golf towel includes a split clamp affixed to the towel. This split clamp is attached to a D-ring metal loop included on traditional golf bags. The main problem with this system is that the split clamp is difficult to secure and detach requiring one hand to hold the metal loop and the other hand to engage the split clamp. This makes this design inconvenient when the need arises to detach the towel for use on the fairway or putting green. A need, therefore, exists for a golf towel including means for securing to a golf bag which allows quick, one-hand operation.

The game of golf presently enjoys enormous popularity. As a result, a lot of attention has been directed at methods of commercially capitalizing on this interest including new media to advertise products or services to golfers or as a means for a golfer to personalize his or her golf equipment. To this end, companies are increasingly sponsoring golf tournaments in an effort to gain exposure to this market. In addition, companies are also increasingly placing their trademarks on golf accessories both as promotional items or for purchase by golfers. Golf towels are particularly suitable for this purpose, especially as promotional items. A need, therefore exists for a golf towel, including a media for uniquely advertising products or services or for personalization of golfing equipment.

SUMMARY OF THE INVENTION

A snap-on golf towel of the present invention includes a towel body, a female snap, and a logo patch. The female snap further includes a first grommet interlocked with a second grommet through a hole punched in the towel body. The logo patch is sewn onto the towel body so as to cover the first grommet, which, when interlocked with the second grommet forms the back side of the female snap. The second grommet includes a bowl-shaped female snap which, when interlocked with the first grommet faces outwardly from the towel body.

Most traditional golf bags known in the industry include at least one male snap integrated into the surface of the golf bag generally on the top cuff of the bag. The known function of these snaps is typically to engage a plurality of female snaps integrated in a golf club hood or cover contemplated to protect the interior of the golf bag and more particularly the golf clubs during storage, transport and/or foul weather. Such hoods are commonly stored in a storage compartment in the golf bag, however, it has been found that in practice, these covers are not frequently used. The female snap, affixed to the towel body, is of a type known to secure textile and flexible materials together through engagement with a matching male snap. For this purpose, the female snap of the present invention is sized so as to interlock with the male snap commonly affixed to most traditional golf bags. It is understood, however, that since the golf bag includes a plurality of male snaps which engage the hood or cover while the snap-on golf towel of the present invention only requires engagement with only one such male snap, it is contemplated that the hood or cover could be installed on the golf bag with the golf towel of the present invention only occupying one such male snap. Accordingly, the snap-on golf towel of the present invention enhances but does not otherwise detract from the utility or operation of the golf bag.

In the event that the golf bag is of a non-traditional design and lacks the male snaps integrated therein. The present golf towel may include a kit which provides the male snap and means for securing the male snap to the golf bag. Such means may include adhesive, Velcro, or any other known method of attachment. In this way the golfer would have the option to secure a male snap on any desired location on the exterior surface of the golf bag.

The male/female snap system of the present invention provide means for quick one-hand attachment and detachment of the towel from the golf bag thereby making the towel easily accessible. When attached, the golf bag (commonly either secured to a golf cart or carry bag stand) provides a vertical support for the towel so as to allow the golfer two free hands to conveniently dry or clean his or her golf clubs and/or golf ball.

The towel may also be rapidly detached from the golf bag by disengaging the male/female snap system. When detached, the golf towel may be carried onto the fairway or putting green to be used to clean/dray the club grip or club face. When the golfer returns to his or her bag, the snap-on golf towel is simply reattached to the golf bag by reengaging the male/female snap system requiring only one-hand operation.

The logo patch provides the dual purpose of aesthetically covering the rear face of the first grommet and also provides media for advertising thereon. Since the logo patch is secured to the towel over the female snap portion, each time the golfer removes the towel from the golf bag, he or she will be exposed to the advertising message placed thereon. Likewise, each time the golfer reattaches the towel to the golf bag, generally on the top cuff of the bag, he or she is likewise exposed to the indicia contained on the logo patch. Further, since the snap-on golf towel is prominently affixed to the exterior of the golf bag, everyone who comes in visual contact with the golf bag will be exposed to the advertising indicia thereon.

It is thus an object of the present invention to provide a novel snap-on golf towel capable of rapid attachment/detachment to/from a golf bag to provide means to clean and/or dry the golfer's hands, golf clubs, golf ball or other golf accessory.

It is a further object of the present invention to provide a novel snap-on golf towel which includes an integral advertising media thereon.

Other aspects, objects and the several advantages of this invention will become apparent from the following detailed description, drawings and appended claims.

DETAILED DESCRIPTION OF THE PREFERRED EMBODIMENT

Figure 1:
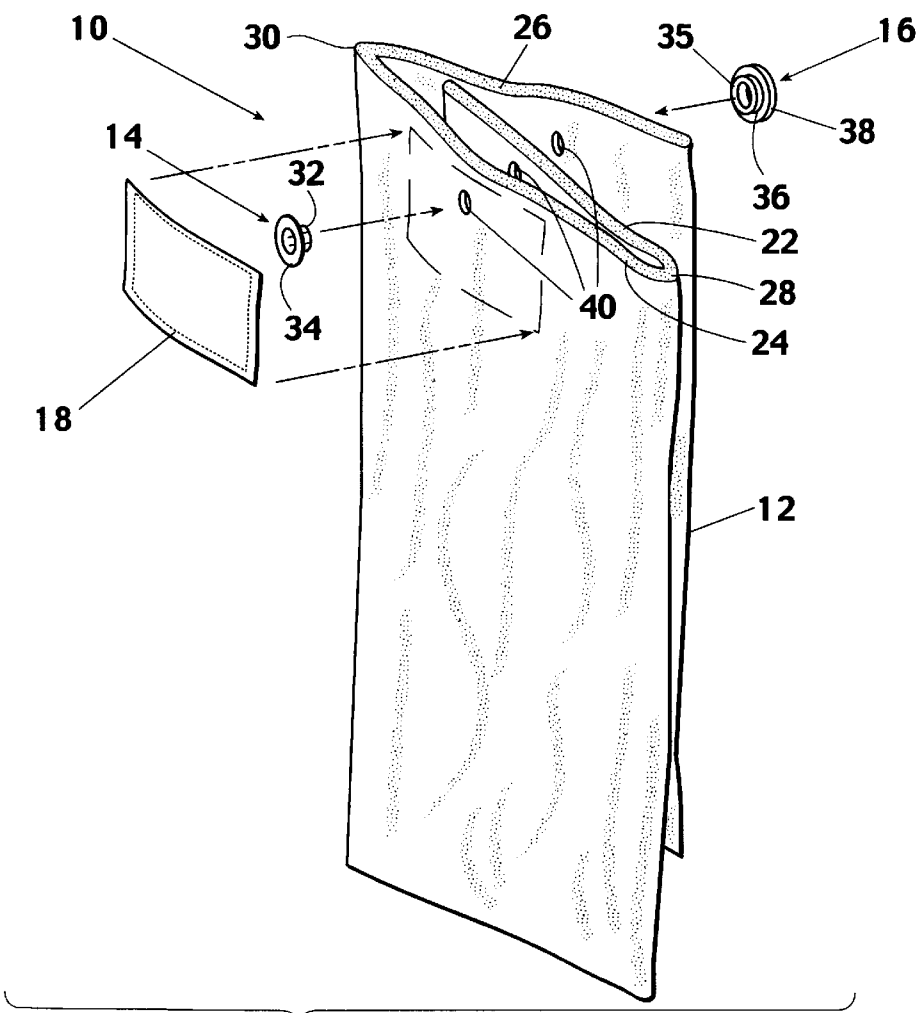
FIG. 1 is an exploded view of the snap-on golf towel of the present invention.
Figure 2:
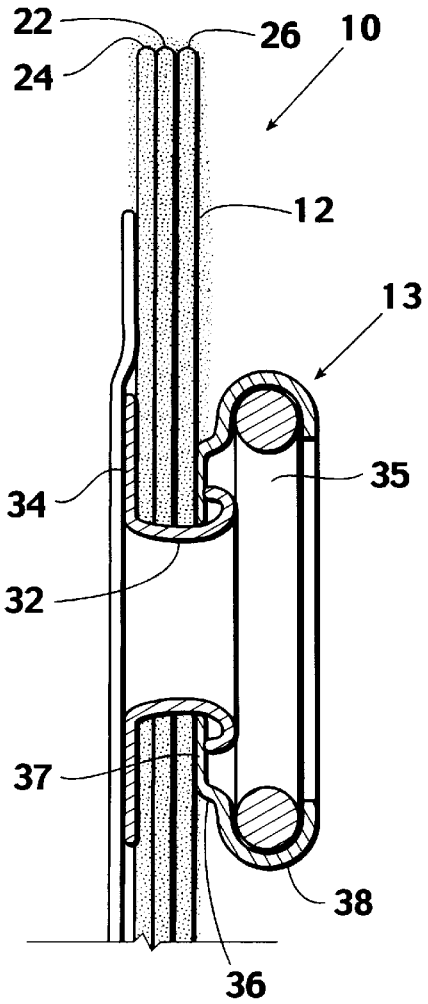
FIG. 2 is a partial longitudinal cross section of the snap-on golf towel of the present invention.

FIG. 1 depicts the snap-on golf towel 10 of the present invention, generally including towel body 12, first grommet 14 capable of interlock with second grommet 16 forming female snap 13 (FIG. 2), and logo patch 18.

Towel 12 is constructed of a liquid absorbent material, preferably cotton or cotton blend, however, any material suitable for the construction of a towel may be substituted. As is shown in FIG. 1, towel 12 is folded in a three-ply configuration whereby a first end segment 22 is folded over a middle segment 24 forming two-plies. A second end segment 26 is then folded over first end segment 22 thereby forming the three-ply configuration. Although the three-ply configuration is preferred, it is understood that other methods of folding, or even a single-ply configuration could be substituted without departing from the spirit and scope of the present invention.

The three-ply configuration, however, is preferred due to the fact that when folded, the three-ply arrangement forms a flexible but also reinforced structure such that first top edge 28 and second top edge 30 will stand up without folding or drooping over middle segment 24, which may cover logo patch 18. Further, as will be discussed below in greater detail, the three-ply configuration forms a "pocket" or sleeve to facilitate cleaning and/or drying golf clubs or balls.

The shape of towel 12 is preferably rectangular or square, however other geometric shapes capable of being folded and secured in the three-ply configuration may also be acceptable. The edges of towel 12 may include a hem to preserve its structural and/or aesthetic properties.

Figure 3:
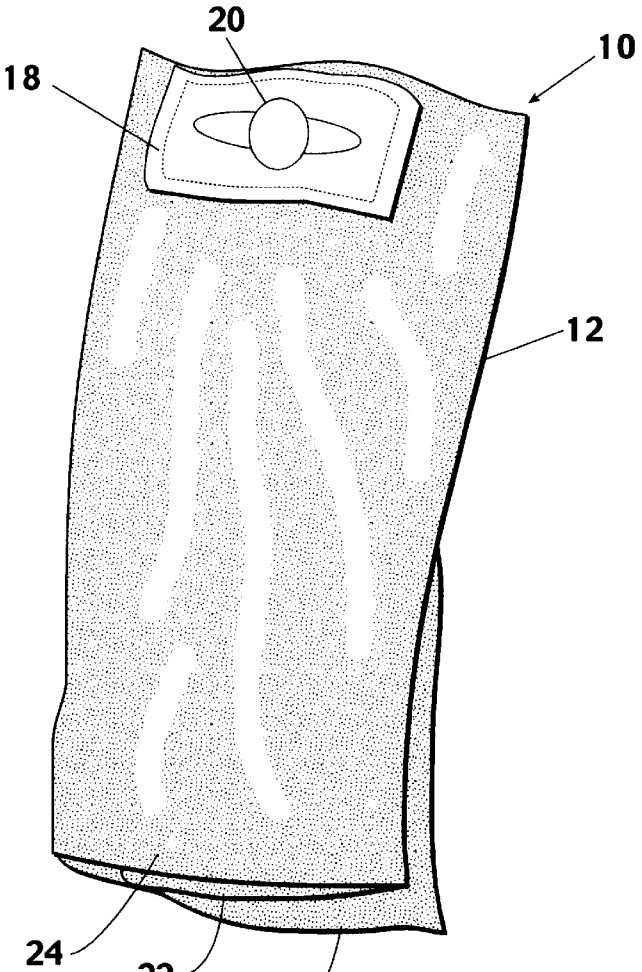
FIG. 3 is an isometric view of an assembled snap-on golf towel of the present invention.

Next referring to FIG. 1 in combination with FIG. 3, segments 22, 24, and 26 are secured together in the three-ply configuration by a female snap comprised of first grommet 14 and second grommet 16. First grommet 14 includes cylindrical extension 32 and annular shoulder 34, while second grommet 16 includes a bowl-shaped female snap portion 38, a lip 36 and an annular hole or recess 35. Lip 36 includes a shoulder 37 thereon. Recess 35 includes an internal diameter of a size capable of receiving cylindrical extension 32 of first grommet 14 such that first grommet 14 and second grommet 16 interlock thereby forming female snap 13.

A hole 40 is punched through segments 22, 24, and 26 in the three-ply configuration such that hole 40 extends completely through the three-plies of towel 12. Hole 40 is of a diameter substantially the same as cylindrical extension 32 of second grommet 14.

Upon assembly of snap-on golf towel 10, first grommet 14 is pressed against middle segment 24 such that cylindrical extension 32 extends through middle segment 24, first segment 22 and second segment 26 via hole 40. Second grommet 16 is then applied such that cylindrical extension 32 of first grommet 14 is inserted inside annular recess 35 and is crimped onto shoulder 37 inside lip 36 thereby securing first grommet 14 to second grommet 16 through hole 40 of towel 12.

First grommet 14 includes a shoulder 34 and second grommet 16 includes shoulder 37 such that towel 12 is sandwiched (pressed) between shoulders 34 and 37 thereby securing first grommet 14 and second grommet 16 to towel 12 through hole 40. In this way, segments 22, 24, and 26 are fixed in the three-ply configuration.

First grommet 14 secured into second grommet 16 through hole 40 of towel 12 forms the entirety of female snap 13. Snaps, such as female snap 13, are known in the textile industry to be suitable as a system for securing two members together and are available at fabric and craft stores.

Once female snap 13 (of FIG. 2) is secured to towel 12, logo patch 18 is affixed to towel 12 over first grommet 14 thereby covering first grommet 14. Logo patch 18 is a means for decoratively covering first grommet 14 and may be any suitable material, however, in the preferred embodiment, logo patch 18 is a rectangular patch known in the textile industry to include a stitched or embroidered logo, trademark, monogram, or other such decorative display. Logo patch 18 is secured to middle segment 24 of towel 12 by any suitable means known for securing such patches which include, but are not limited to, stitching and iron-on glue transfer.

Logo patch 18 includes the above described logo 20 (FIG. 3). As also described, logo patch 18 functions to cover first grommet 14 but also may include a decorative or informational logo 20. Logo 20 could be used by a golfer to customize or personalize his or her golf accessories but may also be used to advertise products or services, such as athletic apparel, soft drinks and the like. Logo patch 18 may also contain no logo thereon but rather be the same color as towel 12 covering first grommet 14. Logo 20 could further be used as a means for identification such as during a golf tournament.

It is common that in golf tournaments, entities sponsoring the tournament provide golf accessories often advertising their goods or services. Such promotional products are generally given to the tournament participants in contemplation that the participant will continue to use the product long after the tournament and thereby continue to advertise the goods or services of the sponsor. It is contemplated that logo patch 18 could bear a logo 20 of such sponsors, thereby prominently advertising the sponsor's goods or services during and after the tournament.

FIG. 3 depicts an assembled snap-on golf towel 10 including towel 12 with logo patch 18 bearing logo 20 secured thereon. As can be seen from FIG. 3, first grommet 14 of FIG. 1, is completely covered and thereby hidden by logo patch 18. Logo patch 18 could be of any size or configuration.

It is also contemplated that, in an alternate embodiment (not shown), the logo patch could be omitted and the advertising indicia printed directly on the towel body. In this alternate embodiment, the back of the first grommet of the female snap would not be covered.

Figure 4:
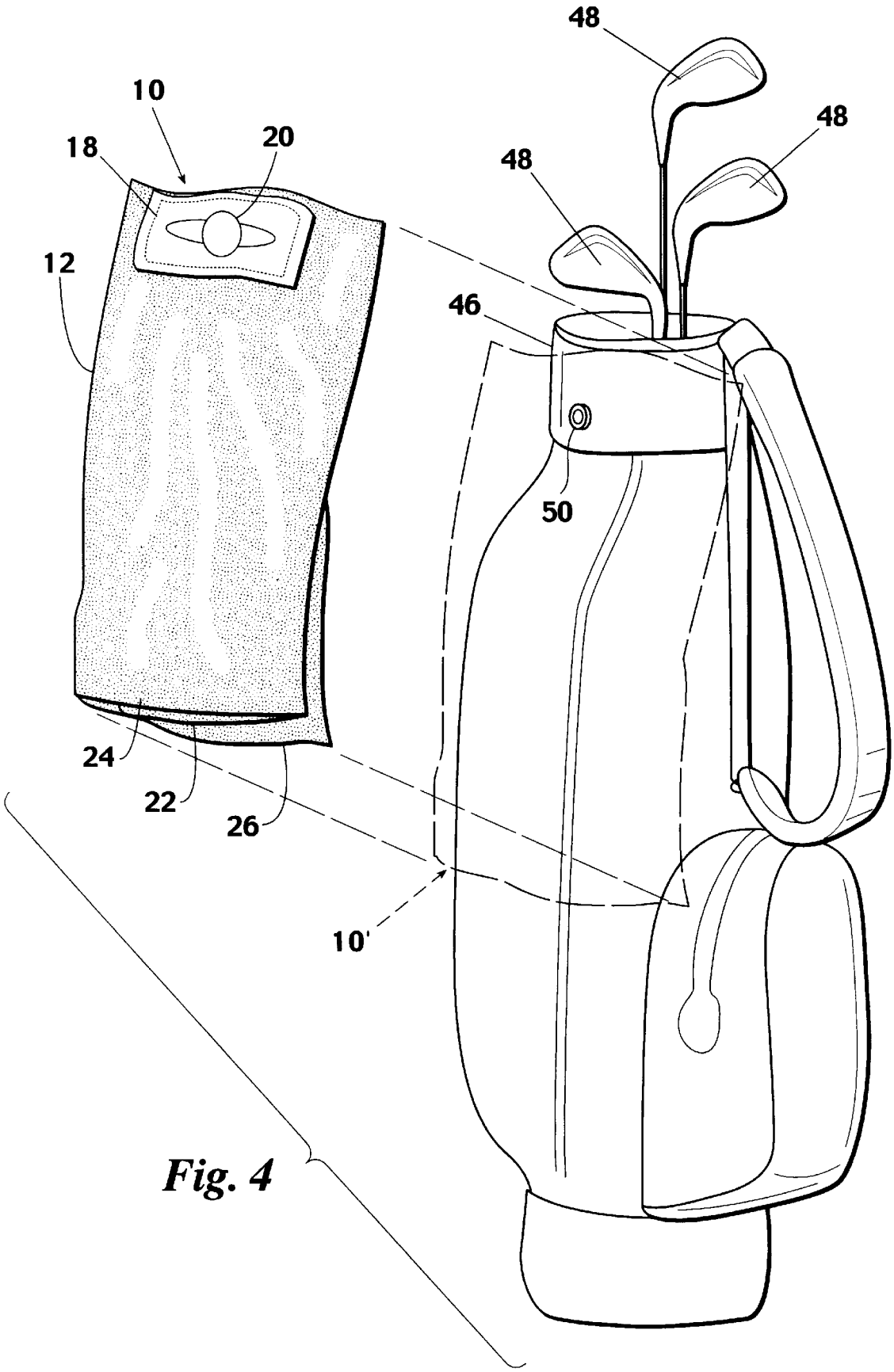
FIG. 4 is a partially exploded isometric view depicting the manner in which the snap-on golf towel of the present invention is affixed to a golf bag.

Referring next to FIG. 4, a standard illustrative golf bag 46 is shown containing illustrative golf clubs, collectively 48. It is common that standard golf bags, such as golf bag 46, include at least one male snap, such as snap 50 shown on golf bag 46. Generally, these male snaps are affixed to golf bags for other purposes, most commonly to receive a cover or hood which often accompanies standard golf bags and is designed to cover the golf clubs during transport, storage, and/or foul weather. However, such covers are rarely used, thereby leaving the male snap, such as snap 50 of golf bag 46, exposed without serving any particular purpose. The female snap (13 of FIG. 2) of the snap-on golf towel 10 of the present invention is intended and configured to receive male snap 50 of golf bag 46 (FIG. 5) thereby providing a useful means of affixing golf towel 10 to golf bag 46 using connection means already partially existing on the golf bag. FIG. 4 depicts golf towel 10 exploded from golf bag 46 wherein the dotted lines represent the placement of snap-on golf towel 10' onto golf bag 46 using male snap 50.

The male/female snap system of the present invention provide means for quick one-hand attachment and detachment of towel 10 from golf bag 46 thereby making towel 10 easily accessible to the golfer. When attached, golf bag 46 (commonly either secured to a golf cart or carry bag stand) provides a vertical support for towel 10 so as to allow the golfer two free hands to conveniently dry or clean golf clubs 48 (or a golf ball or other accessory).

Figure 5:
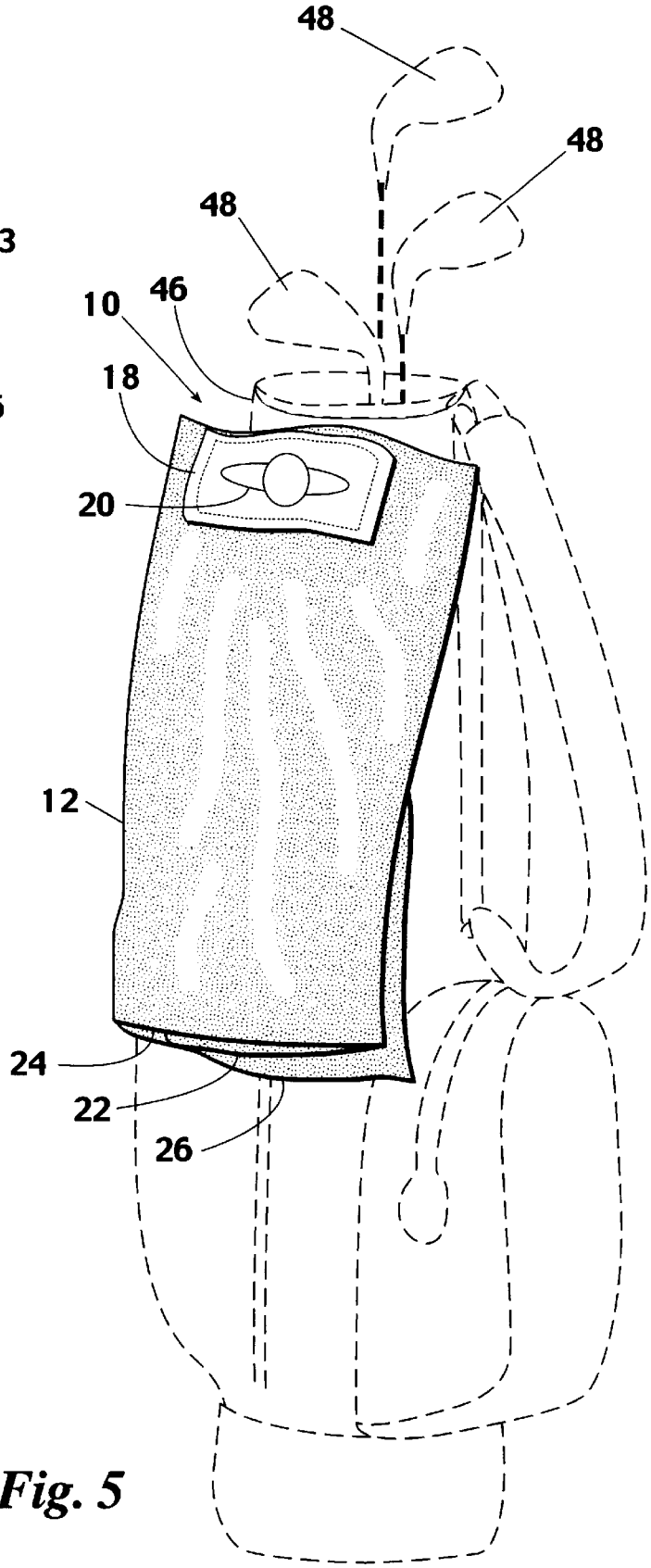
FIG. 5 is an isometric view of a snap-on golf towel of the present invention affixed to a golf bag.

FIG. 5 depicts golf bag 46 (shown in phantom) including golf clubs collectively 48 with snap-on golf towel 10 secured thereon. As can be seen, affixing snap-on golf towel 10 to golf bag 46 as described above conveniently and prominently places golf towel 10 in easy use and reach of the golfer. The three-ply configuration of towel 12 allows the golfer to easily use a part of towel 12 for cleaning his or her hands or golf balls while also allowing golf clubs 48 to be inserted between middle segment 24 and first segment 22 (or second segment 26) such that the golfer can then grab towel 12 around the head of the golf club and thereby clean or dry the head of the golf club as necessary.

In addition, when snap-on golf towel 10 is secured to golf bag 46, logo patch 18 bearing logo 20 is prominently displayed. In this way, logo 12 visually and continuously exposes and/or advertises the goods and services of a company, the monogram of the golfer, or other such personalized effects (such as a happy smile or slogan).

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A golf towel for use with a golf club bag which includes a male snap on its outer surface, comprising:

a towel body including a first segment, a middle segment, and a second segment;

said first segment folded over said middle segment forming a first top edge;

said second segment folded over said first segment forming a second top edge;

said towel body including a hole positioned through said first, middle, and second segments;

a female snap attached to said towel body wherein said female snap mates the male snap on the golf club bag;

said female affixed in said hole securing said first, middle, and second segments together;

said golf club towel being capable of attachment and detachment to the golf club bag by selectively engaging and disengaging said female snap with the male snap.

2. The golf towel according to claim 1 further comprising:

said female snap including a first grommet and a second grommet;

said first grommet capable of interlocking engagement with said second grommet through said hole such that said towel body is pressed between said first grommet and said second grommet.

3. The golf towel according to claim 2 wherein said first grommet and said second grommet include a shoulder thereon such that said middle segment of said towel body is pressed against said shoulder of said first grommet and said second segment of said towel body is pressed against said shoulder of said second grommet.

4. The golf towel according to claim 3, comprising:

said second grommet including a bowl-shaped female snap;

said first grommet being placed over said hole such that said shoulder of said first grommet contacts said middle segment;

said second grommet being placed over said hole such that said shoulder of said second grommet contacts said second segment of said towel;

said first, middle, and second segments of said towel being pressed between said shoulder of said first grommet and said shoulder of said second grommet;

said bowl-shaped female snap on said second grommet capable of engagement with the male snap on the golf club bag; and means for attaching said first grommet and said second grommet.

5. The golf towel according to claim 1 including media for receiving advertising indicia thereon.

6. The golf towel according to claim 1 wherein said towel body includes advertising indicia thereon.

7. The golf towel according to claim 1 wherein a logo patch capable of receiving advertising indicia is affixed to said middle segment of said towel body.

8. The golf towel according to claim 7, wherein said logo patch is affixed to said towel body covering said shoulder of said first grommet.

9. The golf towel according to claim 1 wherein said female snap is positioned between said first top edge and said second top edge.

* * * * *